US011124205B2

(12) United States Patent
Wagniére

(10) Patent No.: US 11,124,205 B2
(45) Date of Patent: Sep. 21, 2021

(54) BODY AND SECONDARY CONTROLLER FOR A RAIL VEHICLE, METHOD FOR CONTROLLING A RAIL VEHICLE, CONTROL PANEL FOR A BODY, AND RAIL VEHICLE

(71) Applicant: STADLER ALTENRHEIN AG, Altenrhein (CH)

(72) Inventor: Marc Wagniére, Winterthur (CH)

(73) Assignee: STADLER RAIL AG, Bussnang (CH)

( * ) Notice: Subject to any disclaimer, the term of this patent is extended or adjusted under 35 U.S.C. 154(b) by 266 days.

(21) Appl. No.: 16/078,208

(22) PCT Filed: Mar. 4, 2016

(86) PCT No.: PCT/EP2016/054621

§ 371 (c)(1),
(2) Date: Aug. 21, 2018

(87) PCT Pub. No.: WO2017/148529

PCT Pub. Date: Sep. 8, 2017

(65) Prior Publication Data

US 2019/0047593 A1 Feb. 14, 2019

(51) Int. Cl.

| | |
|---|---|
| ***B61C 17/04*** | (2006.01) |
| ***B61C 17/12*** | (2006.01) |
| ***B61D 17/06*** | (2006.01) |
| ***B61D 17/20*** | (2006.01) |

(52) U.S. Cl.

CPC ..... *B61C 17/04* (2013.01); *B61C 17/12* (2013.01); *B61D 17/06* (2013.01); *B61D 17/20* (2013.01)

(58) Field of Classification Search

CPC ..... B61C 17/00; B61C 17/04; B61C 17/06; B61C 17/12; B61D 1/00; B61D 17/00; B61D 17/20

See application file for complete search history.

(56) References Cited

FOREIGN PATENT DOCUMENTS

| | | | | |
|---|---|---|---|---|
| CA | 2 498 256 | A1 | 3/2004 | |
| DE | 1 108 722 | | 6/1961 | |
| DE | 85 02 804 | U1 | 5/1985 | |
| EP | 0 167 766 | A2 | 1/1986 | |
| EP | 0 187 413 | A2 | 7/1986 | |
| EP | EP-0187413 | A2 * | 7/1986 | ..... B61D 17/20 |
| EP | 0 608 455 | A1 | 8/1994 | |
| EP | 3294603 | B1 | 9/2019 | |
| WO | 86/03463 | A1 | 6/1986 | |

(Continued)

OTHER PUBLICATIONS

International Search Report Corresponding to PCT/EP2016/054621 dated Jan. 3, 2017.

(Continued)

*Primary Examiner* — Robert J McCarry, Jr.
(74) *Attorney, Agent, or Firm* — Finch & Maloney, PLLC; Michael J. Bujold; Jay S. Franklin

(57) ABSTRACT

A body (1) for a rail vehicle (100) comprising a control panel (4) for controlling the rail vehicle (100). The control panel (4) has a rest position and an operational position and, in the rest position, is located in a control panel holder (41) while, in the operational position, is at least partially located outside the control panel holder (41) such that control elements (42) are accessible for operation.

13 Claims, 4 Drawing Sheets

(56) References Cited

FOREIGN PATENT DOCUMENTS

Figure 1:
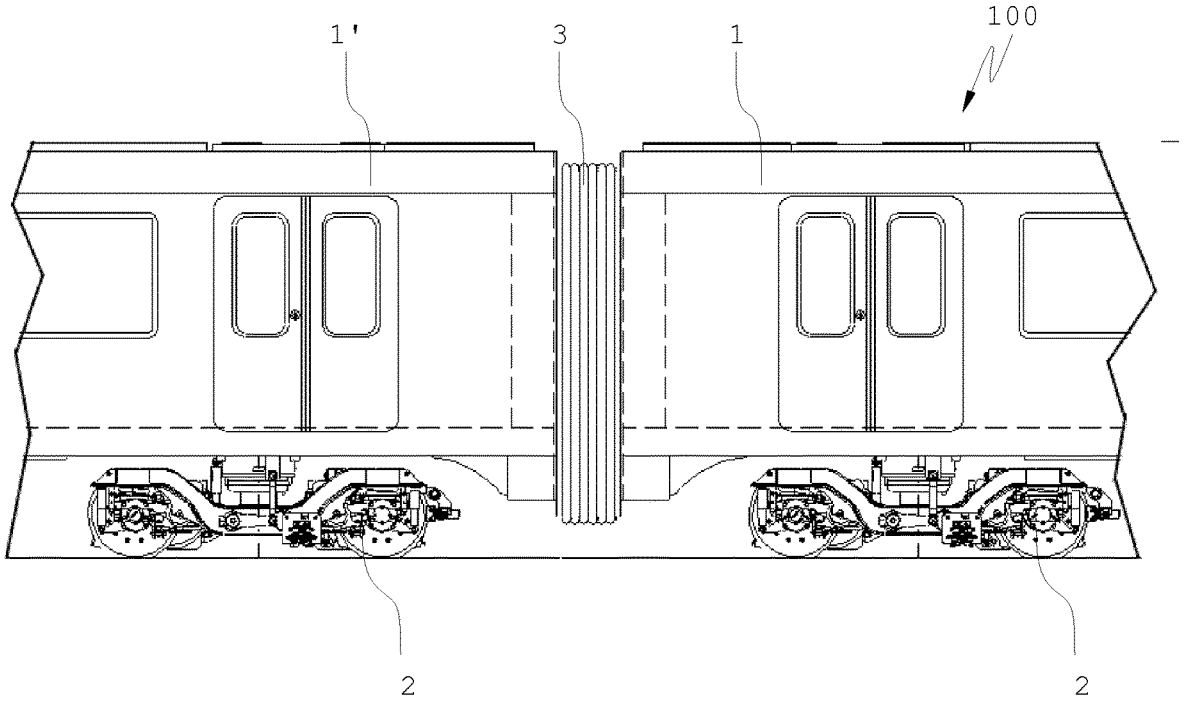

| | | | |
|---|---|---|---|
| WO | 2004/024529 | A1 | 3/2004 |
| WO | 2017021457 | A1 | 2/2017 |

OTHER PUBLICATIONS

Written Opinion Corresponding to PCT/EP2016/054621 dated Jan. 3, 2017.

European Office Action issued in corresponding European Patent Application No. 16 708 397.1 dated Nov. 15, 2019.

* cited by examiner

BODY AND SECONDARY CONTROLLER FOR A RAIL VEHICLE, METHOD FOR CONTROLLING A RAIL VEHICLE, CONTROL PANEL FOR A BODY, AND RAIL VEHICLE

The present invention relates to a vehicle body for a rail vehicle, a rail vehicle comprising a vehicle body, an auxiliary control for a rail vehicle, a method for controlling a rail vehicle, and a control panel for a vehicle body according to the independent claims.

Different kinds of control panels and controllers for rail vehicles are known from the prior art. For example, DE8502804 presents a control panel which is displaceable within a vehicle body. Alternatively, the control panel can be directly fastened to a connecting door of the vehicle body, so that the control panel releases a passageway for passengers by swinging open the door. The control panel also comprises a chair for a driver and controls the entire train in the form of the main controller.

This known device has the disadvantage, inter alia, that the door can be closed only when the control panel is likewise located in the passageway region for the passengers. The control panel also cannot be removed from the range of the passengers and takes up a lot of space within the vehicle body. It is possible for the control elements fitted on the control panel to be manipulated at all times.

The object of the invention is therefore to overcome this and further disadvantages of the prior art. In particular, a vehicle body for a rail vehicle, an auxiliary control for a rail vehicle, a method for controlling a rail vehicle, and a control panel for a rail vehicle shall be provided which make it possible for parts of a train to be shunted only by means of authorised staff, without use of a separate locomotive. The passenger capacity should also be as high as possible.

This and further objects are achieved by the devices and methods defined in the independent claims. Further embodiments shall become clear from the dependent claims.

A vehicle body according to the invention for a rail vehicle comprises a control panel for controlling the rail vehicle. The control panel is in particular an auxiliary control panel. The vehicle body comprises a control panel receptacle for receiving the control panel, wherein the control panel has an arrangement of control elements. The control panel is repositionable from a rest position into an operating position. The control panel is arranged in the control panel receptacle in the rest position and is arranged at least partially outside the control panel receptacle in the operating position. The control panel is arranged in the operating position in such a way that the control elements are accessible for operation.

The term 'rail vehicles' is understood here and hereinafter to mean a composition of at least two bodies, wherein in particular at least one of the bodies is a railcar. A railcar is a vehicle body that has at least one driveable bogie. Rail vehicles for example thus also comprise metro vehicles and trams. Metro vehicles and trams are composed predominantly of a plurality of individual sub-compositions, for example composition pairs formed of two bodies, wherein in each case at least one or both of the bodies is/are formed as a railcar. Metro compositions of this kind are preferably divided into the individual composition pairs for shunting, such that there is space for them in the corresponding shunting yards and workshops. In particular, the control panel receptacle is arranged in a vehicle body to which passengers have access. Thus, there is no need for a separate locomotive in order to shunt the rail vehicle or the sub-composition.

A vehicle body according to the invention comprises the car body, which rests on two bogies, irrespective of whether the bogies are Jacobs bogies or bogies having one or two axles. The vehicle body furthermore also comprises the interior trim and therefore is not limited to the static car body structure. As much space as possible is provided in the vehicle body for passengers, for example seats, luggage racks, wheelchair spaces and/or toilets are thus formed in the vehicle body.

In accordance with the invention a vehicle controller is actuatable by the main controller and/or the auxiliary control. The vehicle controller controls either the entire rail vehicle or individual sub-compositions, if these have been decoupled or only part of the rail vehicle is to be controlled.

The arrangement of the control panel in a control panel receptacle enables an expedient and stable fastening of the control panel to an element of the vehicle body. The control panel receptacle thus enables the control panel to be stowed in a manner secure against manipulation, such that unauthorised operation is made impossible. To this end, the control panel receptacle preferably is a recess, preferably within a trim element, of the vehicle body. In addition, the control panel for example can be separated from the rest of the vehicle body interior and preferably can have a plurality of side walls. Here, a side wall can be formed by an end plate of the control element. It is thus also ensured that the control elements are accessible only in the operating position. This enables operation of the control elements in a desired position, and prevents manipulation of the control elements in another position.

The control elements of the control panel are preferably inaccessible in the rest position.

On the one hand, as already presented here, security against incorrect handling by passengers is thus increased. In addition, it is ensured that steps necessary prior to operation of the control elements are carried out by the operating staff prior to operation and as much space as possible is available in the vehicle body for passengers.

The control panel receptacle is preferably arranged in a side wall of the vehicle body of the rail vehicle. The side wall in which the control panel receptacle is arranged can be formed as a side wall of an end wall trim.

Bodies typically have an elongate extent in the direction of travel, wherein the terminating walls in and against the direction of travel are referred to as end faces. End walls are arranged at the end faces. A plurality of bodies of identical or different design, for example a railcar body and a vehicle body without independent drive, can be connected to one another at their end faces. The end faces of two bodies are typically connected to one another by means of a folding bellows. Here, through-openings, which preferably are closed by a connecting door, are formed in the end walls of the bodies. The connecting door can be formed as a sliding door or revolving door. In order to receive the connecting door and/or in order to receive further components of the vehicle body, such as cables, the end walls can be provided with an end wall trim, which for example forms a cavity. The end wall thus has a depth overall which extends in or against the direction of travel. Here and hereinafter, this design of the end wall trim will be referred to as an end wall box. The end wall trim and thus the end wall box has a side wall along its depth, in which side wall there is preferably arranged the control panel receptacle. Either one or more seats, a luggage rack, a toilet or a wheelchair space or other fixtures or fittings is/are preferably formed on the end wall trim, such that the space for passengers is utilised optimally.

This enables the control panel to be received in a protected region separate from the passenger compartment, without reducing the passenger capacity.

End wall boxes are typically located in the direction of travel to the left and right of a passageway and therefore to the left and right of a clearance for the passage of people.

The control panel is preferably arranged, in the rest position, outside this clearance for the passage of people and in particular is pivotable or extendable from the operating position out of the clearance into the rest position.

On the one hand, this enables unhindered access and passage of passengers in the event that the control panel is not being used. The control panel is preferably in operation when the train composition or parts of the train composition of the rail vehicle are in a shunt mode or in an auxiliary operating mode.

In order to launch the control panel, the control panel is preferably pivoted into the operating position and thus into the clearance for the passage for people. The pivot axis and therefore the control panel in an operating position is preferably located substantially at hip height of the operator, that is to say at a height of approximately 1 m from the floor of the vehicle body.

The operator of the control panel must therefore assume a predefined position, which, in addition to the control panel, also blocks the passage for people.

Doors can typically be arranged in the end walls of the bodies. Such doors can be connecting doors or fire doors. Connecting doors usually open as soon as the passenger comes into the vicinity, whereas fire doors are opened in the event of normal operation and close only in the event of a fire or upon a separate request, for example at the time of shunting. Doors of this kind can have windows. The control panel is preferably arranged here in the operating position in such a way that the operator of the control panel can view the track (for example through the window of a closed connecting door). In the case of shunting operation, a door of this kind can be closed or opened by means of the control panel. It is recommended to close a door during shunting operation in order to keep weather influences and soiling as low as possible. Alternatively, however, a passageway can also be covered by a temporary protective covering or a roller tarpaulin.

The control panel preferably comprises an end plate, which is arranged in such a way that the end plate forms a common surface with the side wall of the vehicle body in the rest position. The common surface is preferably substantially closed. This, naturally, does not rule out gaps between the end plate and the side wall. The end plate of the control panel can be formed for example as a separate end plate, on which the control panel can be fastened, or the end plate can be part of the housing of the control panel and thus simultaneously end plate and side wall of the control panel. Furthermore, the control panel can be fastened releasably to the end plate, such that the operator can remove the control panel and the control panel is securely stowed in the rest position.

By means of the arrangement described here, the end plate prevents parts of the control panel from protruding beyond the side wall and thus forming dangerous corners or edges or additionally reducing the clearance for the passage of passengers.

The control panel for example can be formed extendably, pivotably or removably. This means that the control panel is movable for example in a linear movement, preferably on telescopic rails, away from the side wall of the vehicle body, in particular the end wall box. Alternatively, it is conceivable that the control panel can be pivoted out from the side wall of the vehicle body by means of a rotary movement. Here, the control panel can be arranged on an individual axis of rotation. A rotary movement about a multiple-joint hinge or a superimposed rotary/pulling movement is also conceivable. The control panel is preferably secured to any mobile element of the vehicle body. The control panel is therefore not secured to a connecting door. Furthermore, the control panel alternatively can be formed such that it can be fully removed from the control panel receptacle. Here, the control panel can comprise a carrying device, by means of which the operator can carry the control panel and preferably can hold it in an operating position.

This enables reliable and simple fastening of the control panel and a simple operation of the control panel. In particular by means of a pivoting motion, it is possible to securely and accurately produce the rest position and the operating position. Here, it can be provided to provide stops for both positions on the control panel and/or in the end wall, which stops precisely define the position and additionally or alternatively can absorb forces that act on the control panel. A removable control panel has the advantage that the operator can determine the position himself, yet nevertheless can control the rail vehicle or the sub-composition.

The axis of rotation preferably extends substantially in the direction of a direction of travel of the rail vehicle.

It is thus made possible that movements or forces produced by the acceleration or braking of the rail vehicle can be absorbed and that the position of the control panel about the axis of rotation does not change. Furthermore, an axis of rotation of this kind leads to an optimal pivot range, which has no influence on the passenger capacity.

In the present application, the term "substantially" is understood to mean that the following value does not have to be provided absolutely precisely, and instead for example deviates from a predefined direction by a negligible amount. For example, the term "substantially at right angles" is to be understood such that both exact right angles and angles with a certain deviation from a right angle are included. Likewise, the term "substantially in the direction of the direction of travel" means precisely in the direction of the direction of travel and also directions that extend in the same direction as the direction of travel, but are not exactly parallel thereto.

The axis of rotation can additionally or alternatively be oriented substantially horizontally.

This facilitates manufacture and assembly. In addition, the horizontal design of the axis of rotation enables simple and secure operation of the control elements of the control panel.

In order to secure and lock the control panel, locking means can be mounted on the control panel. Means of this kind are preferably arranged in the end plate. Here, it is conceivable that these locking means are formed in such a way or comprise an additional element such that it is possible to trigger a signal which can be used in the control of the train. Locking means for example can be mechanical or magnetic or can be actuated mechanically or electronically. Operation of the locking means is possible using a key, a magnet, an RFID key, an NFC key (near field communication), or the like.

In a further advantageous embodiment, means for determining the position of the control panel, in particular for determining the rest position and/or the operating position, can be arranged on the control panel. Means of this kind for determining the positions can be sensors, such as position and/or motion sensors and/or contact sensors.

Alternatively, it is possible to form both the locking means and the position-determining means in a combined manner. For example, contact sensors can be formed on the locking means for this purpose.

It is thus possible to determine the state of the control panel, specifically the locking or unlocking, and additionally to determine the end position, which makes it possible to trigger a signal that contains this information and that is usable in the control of the rail vehicle.

The position-determining means or the locking means are preferably designed to switch the control panel and/or the controller of the rail vehicle and/or the rail vehicle into an auxiliary operating mode.

In an auxiliary operating mode, the permissible speed of the rail vehicle can be restricted, for example. In the auxiliary operating mode, additional control options can also be released, or for example alarm lights can be triggered. Furthermore, in the auxiliary operating mode it is possible for only part of the train composition to be driven, for example only two bodies, wherein only one drive motor is necessary for this part of the train composition. However, the use of all drive motors provided in this train part, or some of the drive motors is also possible. The use of the provided drive motors or also an additional shunt motor per part of a train composition is conceivable.

In the auxiliary operating mode at least one of the following elements preferably is bypassable: the controller of an automatic connecting door opening of one or more connecting doors; the main controller of the rail vehicle.

It is also possible to set the controller in operation at the control panel by switching on the auxiliary operating mode. Furthermore, the auxiliary operating mode can also be switched on only for the decoupling of part of the train composition.

For example, a mutual locking of main controller and auxiliary control or main control panel and a control panel as described in the present application can thus be created.

The control elements of the control panel are preferably arranged in a plane, wherein the plane can be oriented substantially horizontally in the operating position and/or can be oriented substantially vertically in the rest position. The plane is additionally preferably formed in such a way that it is accessible in a standing position of the operator, i.e. in particular at a height of substantially 1 m.

In the operating position, this enables operation of the control elements in an ergonomically advantageous position. Here, it is conceivable that the plane is inclined with respect to the direction of travel or that the control elements are arranged at an incline relative to the plane.

The vehicle body is preferably formed in such a way that a pivoting movement of the control panel extends transversely and preferably at right angles to the direction of travel of the rail vehicle in a plane at right angles to the direction of travel.

Simple operation and simple movement of the control panel from the rest position into the operating position is thus made possible. In particular, it is made possible that forces resulting at the rail vehicle as a result of acceleration or braking no longer influence the pivoting movement of the control panel, thus preventing the control panel from pivoting out randomly.

The control panel can comprise communication means, by means of which communication with a vehicle controller is possible. This communication channel can communicate with the vehicle controller via cables or via electromagnetic waves. In particular in the case of a removable control panel, wireless communication between the control panel and vehicle controller is preferred.

A further aspect of the invention relates to a rail vehicle comprising a vehicle body as described herein. The rail vehicle thus has all of the advantages described herein.

The rail vehicle can preferably additionally comprise a main control panel, which for example is arranged in a separate additional railcar. Here, the main control panel can cooperate with the control panel described herein, in such a way that for example certain functions are locked to one another if the control panel as described herein is in an auxiliary operating mode.

A complete train position or for example a metro composition can thus be provided, which is driveable using a main control panel and shuntable using an auxiliary control panel, in particular parts of the train composition are shuntable.

A further aspect of the invention relates to an auxiliary control for a rail vehicle. The auxiliary control comprises control elements which are arranged pivotably or extendably on a control panel. The auxiliary control comprises at least one control element, by means of which a control signal for bypassing a main controller and/or for bypassing the controller of an automatic connecting door is generatable, or by means of which the main controller and/or the controller of a connecting door is bypassable.

An auxiliary control is thus provided by means of which a defined state in a rail vehicle can be created. This increases the safety for the operator and prevents inadmissible manipulation when the auxiliary control is in use.

The control element of the auxiliary control is preferably arranged on the control panel in such a way that the signal or the bypassing is generatable compulsorily depending on the position of the control panel. It is thus ensured that as soon as the control panel is in a defined position, desired or specific functions are switched on and/or off.

A further aspect of the invention relates to a method for controlling a rail vehicle and/or a vehicle body composition, in particular part of a vehicle body composition. In a first step a control panel, preferably a control panel as described herein, is unlocked, preferably unlocked mechanically or electronically, and in a second step the control panel is brought from a rest position into an operating position. Here, by bringing the control panel from the rest position into the operating position, a controller of the rail vehicle and/or a controller of a connecting door is bypassed. This enables the advantages as described herein, in particular for the auxiliary control. In the rest position the control elements of the control panel are not accessible, and are therefore only accessible in the operating position.

The auxiliary control is preferably formed on a control panel as described herein.

A further aspect of the invention relates to a control panel for a vehicle body as described herein and/or for an auxiliary control as described herein and/or for carrying out a method as described herein. The control panel comprises at least one end plate and an arrangement of control elements.

Figure 2:
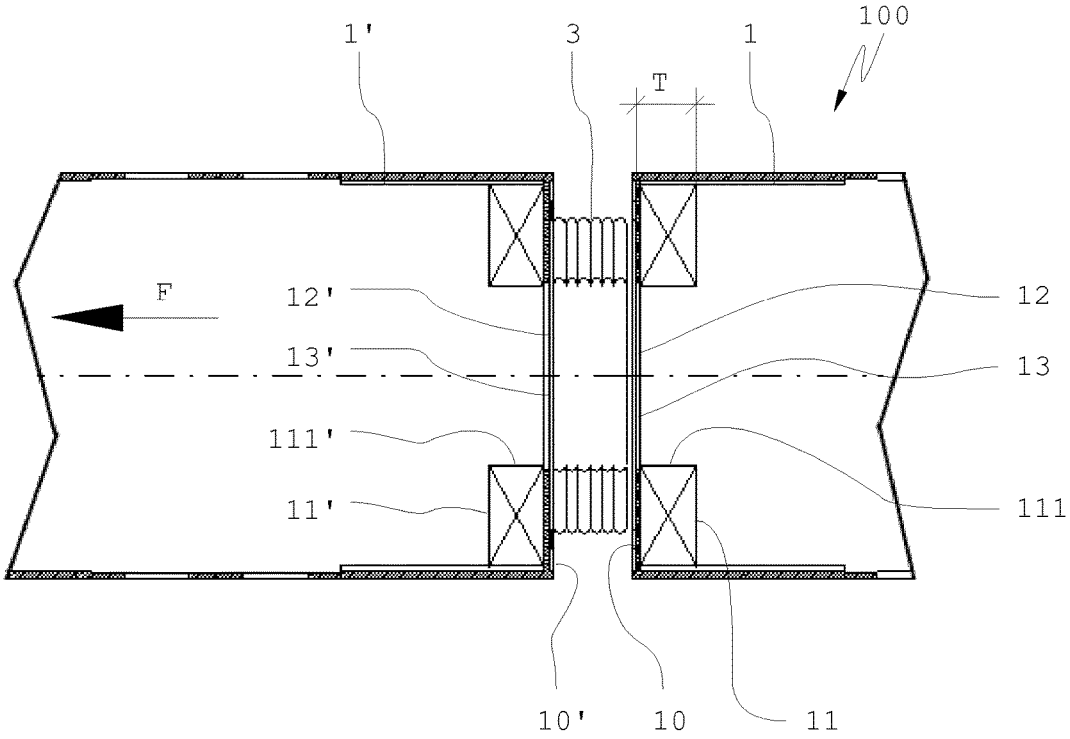
Figure 3:
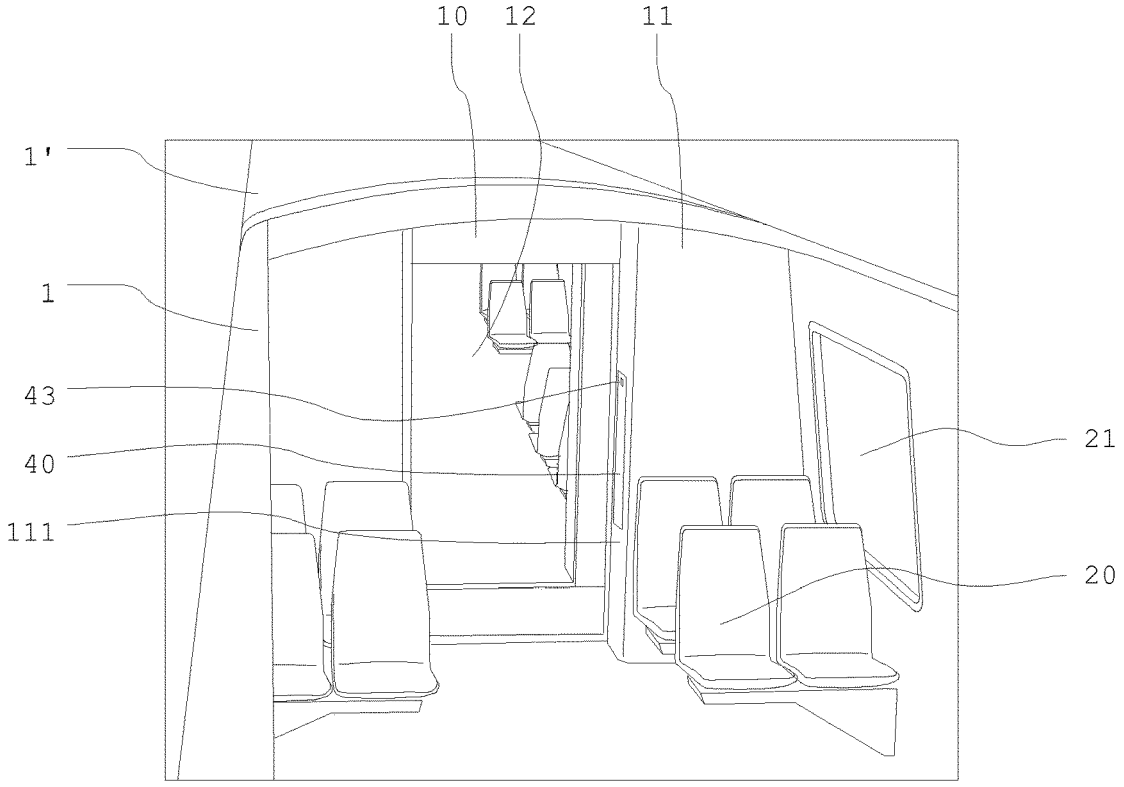
Figure 4:
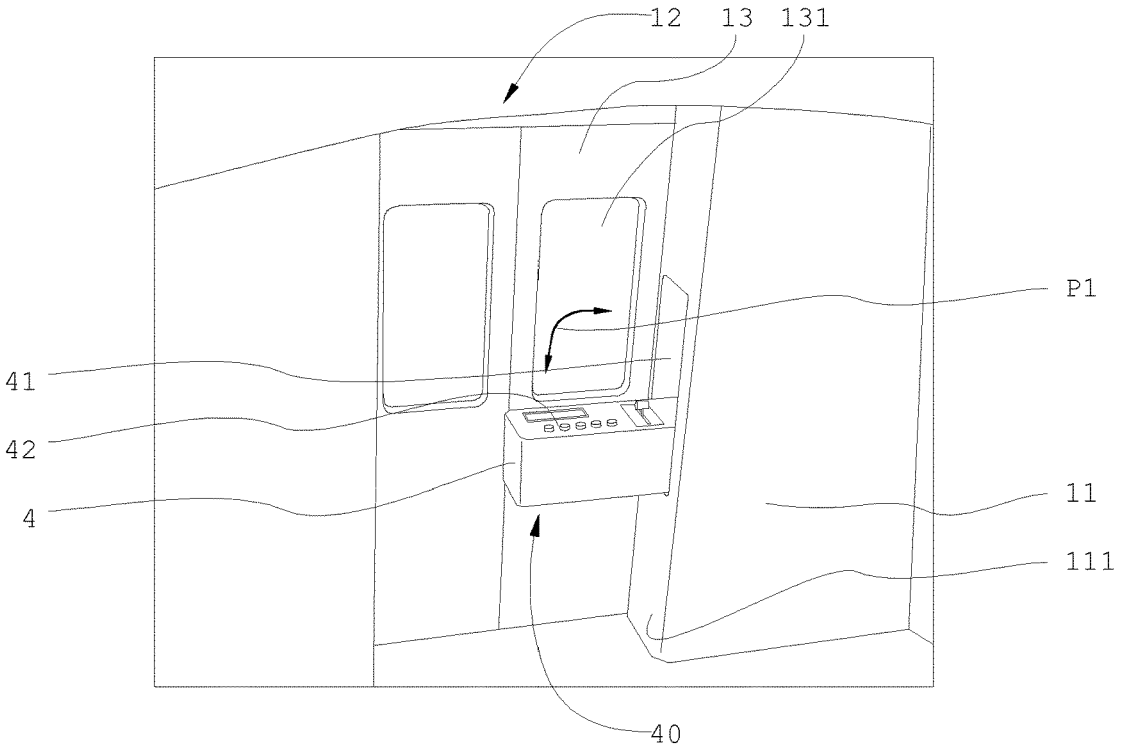
Figure 5:
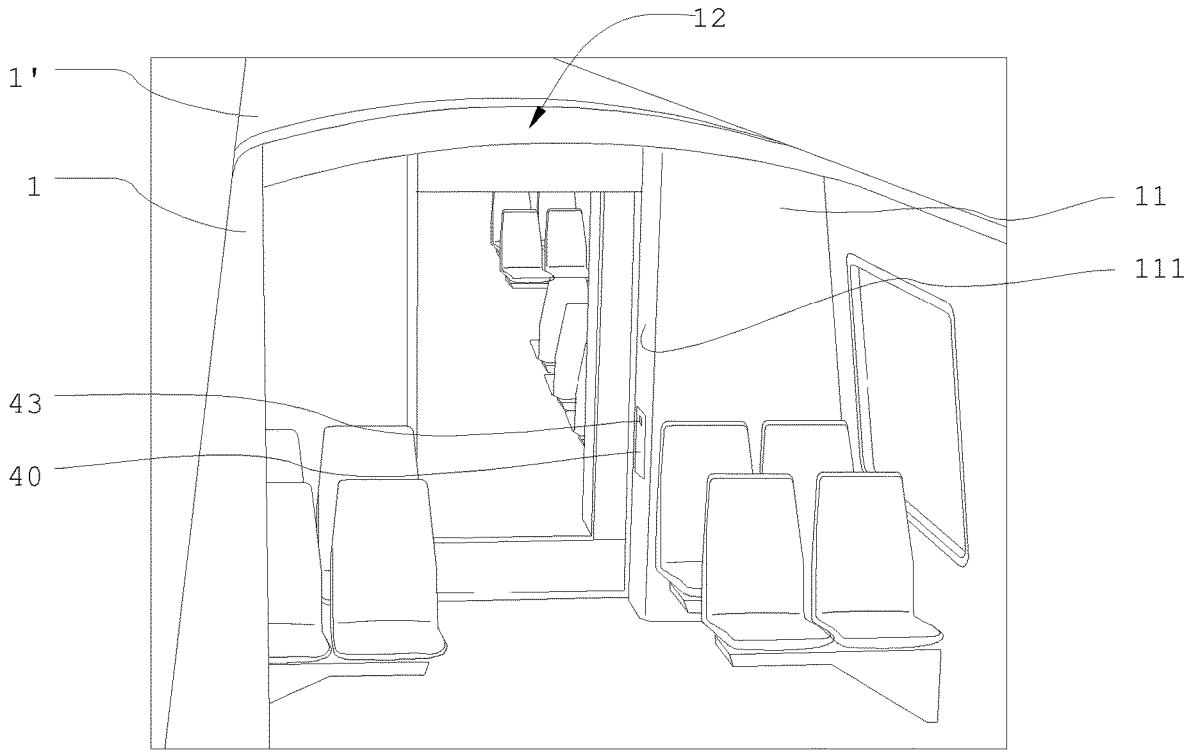
Figure 6:
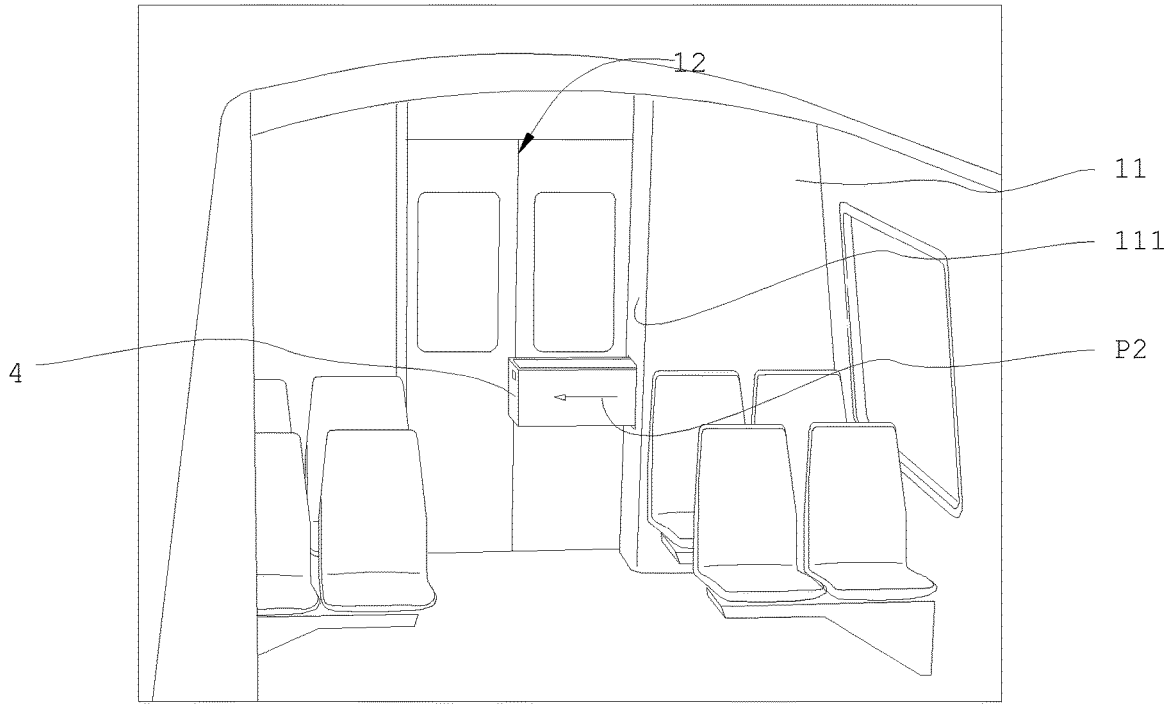
Figure 7:
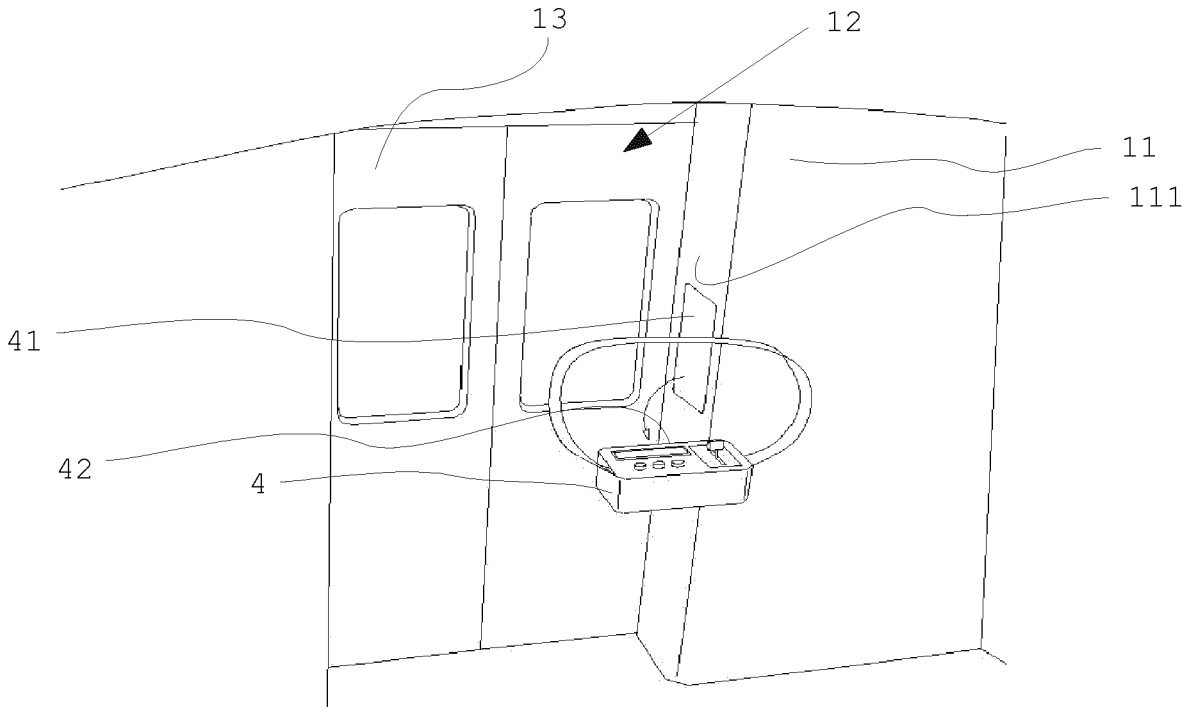

A plurality of exemplary embodiments of the present invention will be described with reference to the following figures, in which:

FIG. 1: shows a detail of a rail vehicle;

FIG. 2: shows a plan view of the detail of FIG. 1;

FIG. 3: shows an inside view with the rail vehicle from FIG. 1;

FIG. 4: shows a first embodiment of a control panel in the operating position;

FIG. 5: shows an alternative inside view of the rail vehicle from FIG. 1;

FIG. 6: shows the view from FIG. 5 with an alternative embodiment of the control panel in an operating position;

FIG. 7: shows an inside view of the rail vehicle from FIG. 1 with an alternative embodiment of the control panel in the operating position.

FIG. 1 shows a detail of a typical configuration of a rail vehicle. Two bodies 1, 1' face one another each by one of their end faces and are connected to one another by means of a folding bellows 3 at their end walls 10, 10' (see FIG. 2). They form part of a rail vehicle 100 comprising further bodies 1, 1'. The vehicle body 1 has a second end (not referenced here), which in the present case is formed similarly to the end, shown here, of the vehicle body 1'. The vehicle body 1 is thus arranged on two bogies 2. The vehicle body 1' is configured accordingly. At least one of the bogies 2 has a drive, whereby autonomous travel with the vehicle body composition 1, 1' as shown in the present case is possible.

FIG. 2 shows a cropped plan view of the vehicle body composition 1, 1' from FIG. 1. As explained with reference to FIG. 1, the bodies 1 and 1' are connected to one another by means of a folding bellows 3. The bodies 1 and 1' have end walls 10 and 10' at their end faces, said end walls being arranged opposite one another. Passageways 12 and 12' for people are formed in the end walls 10 and 10'. The passageways 12 and 12' are each closed by sliding doors 13 and 13' respectively. The end walls 10 and 10' have an end wall trim 11 and 11', which extend over a depth T in the direction of travel F. The end wall trims 11 and 11' also have a side wall 111 and 111'. The end wall trims are in the present case arranged substantially symmetrically with respect to a central axis of the rail vehicle 100.

FIG. 3 shows an inside view of the rail vehicle 100 from FIGS. 1 and 2. Two bodies 1 and 1' are arranged in succession in the direction of travel, and the passageway 12 between the bodies 1 and 1' is open. Seats 20 are arranged inside the bodies. The seats 20 are arranged inter alia on the end wall trim 11, so that as much passenger capacity as possible is provided in each vehicle body 1 and 1'. A window 21 can also be seen. An end wall trim 11 is arranged on the end wall 10. The end wall trim 11 comprises a side wall 111, in which a control panel 4 (see FIG. 4) is arranged, although only the end plate 40 of said control panel is visible. A locking mechanism 43 is located in the end plate 40. The control panel 4 (FIG. 4) is arranged in a control panel receptacle 41 (FIG. 4) and is shown in the rest position. The control elements are not accessible in the rest position.

FIG. 4 shows the interior according to FIG. 3, wherein the control panel 4 is shown an operating position. Here, the passageway 12 is closed by the sliding door 13. A window 131 in the sliding door 13 is visible. The control panel 4 is pivoted from the rest position (see FIG. 3) into the operating position shown here. More specifically, the control panel 4 has been pivoted out from the control panel receptacle 41. The control panel receptacle 41 is arranged in the side wall of the end wall trim 11 and therefore in the end wall trim 11. The control panel 4 comprises control elements 42. The end plate 40 is pivoted downwardly together with the control panel 4 in the pivot direction P1. For operation of the control panel 4, the operator must adopt a position on the basis of the operating position shown in FIG. 4, which allows the operator to view a route of travel through the window 131 and the connecting door 13. By folding down the control panel 4, a switching element was actuated, which triggered a signal bringing the connecting door into the closed position and/or bypassing or preventing automatic opening of the connecting door. A main controller of the train is additionally bypassed, such that the rail vehicle can be controlled merely with the control panel shown here. Furthermore, no further coaches are coupled in the viewing direction of the operator through the window 131. A sub-composition is thus provided, which can now be shunted.

FIG. 5 shows an alternative configuration of the interior according to FIG. 3 or of the interior of a rail vehicle/vehicle body composition according to FIG. 1. The passageway 12 between two bodies 1, 1' is open in the present case. A control panel 4 (FIG. 6) is arranged in an end wall trim 11 comprising a side wall 111. The seats 20 are arranged inter alia on the end wall trim 11, such that the greatest possible passenger capacity is provided in the bodies 1 and 1'. Merely the end plate 40 of the control panel 4 is visible. A locking mechanism 43 for locking the control panel 4 is located in the end plate 40. The control panel 4 is located in the present case in a rest position. The control elements are not accessible in the rest position.

FIG. 6 shows the interior according to FIG. 5, wherein the control panel 4 has been pulled out from the side wall 111 of the end wall trim 11 in a linear movement along the arrow P2 and has been brought into an operating position. The vehicle body 1' has also been decoupled, such that the vehicle body 1 can now be shunted. The functions correspond to those functions for the operating positions as described in FIG. 4 and therefore will not be repeated for the sake of clarity.

FIG. 7 shows the interior according to FIG. 3, wherein the control panel 4 is shown in an alternative embodiment in the operating position. Here, the passageway 12 is closed by the sliding door 13. The control panel 4 is removed from the rest position (see FIG. 3) in the operating position shown here. More specifically, the control panel 4 has been completely removed from the control panel receptacle 41. The control panel receptacle 41 is arranged in the side wall 111 of the end wall trim 11 and thus in the end wall trim 11. The control panel 4 comprises control elements 42. For operation of the control panel 4, the operator can put on the carrying belt and can move freely in the rail vehicle. By removing the control panel 4, a switch element was actuated, which triggered a signal bringing the connecting door into the closed position and/or bypassing or preventing automatic opening of the connecting door. A main controller of the train is additionally bypassed, such that the rail vehicle can be controlled merely by means of the control panel 4 shown here. The control panel 4 communicates with the vehicle controller wirelessly. A sub-composition is produced, which can now be shunted. Seats (not shown) are arranged in the vehicle body so that passengers can also travel in the vehicle.

The invention claimed is:

1. A vehicle body for a rail vehicle comprising:

a control panel for controlling the rail vehicle, and a control panel receptacle, wherein the control panel comprises an arrangement of control elements, the control panel is repositionable from a rest position into an operating position, and in the rest position, the control panel is arranged in the control panel receptacle and, in the operating position, is arranged at least partially outside the control panel receptacle in such a way that the control elements are accessible for operation, wherein the control panel receptacle is arranged in the side wall of an end wall trim of the vehicle body of the rail vehicle, wherein the control panel is arranged outside a clearance of a passageway for people in the rest position, wherein the control panel is at least one of pullable out from the side wall of the end wall trim in a linear movement and pivotable around a substantially horizontal axis into an operating position and fully removable from the control panel receptacle from the rest position in the operating position and comprise means of which the operator can carry the control panel and preferably can hold it in an operating position.

2. The vehicle body for a rail vehicle according to claim 1, wherein the control elements of the control panel are inaccessible in the rest position.

3. The vehicle body according to claim 1, wherein the control panel comprises an end plate, which is arranged in such a way that the end plate and a side wall of the vehicle body, in the rest position, form a common surface.

4. The vehicle body according to claim 1, wherein the axis of rotation extends substantially in a direction of a travel direction of the rail vehicle.

5. The vehicle body according to claim 1, wherein means for determining the position of the control panel are arranged on the control panel.

6. The vehicle body according to claim 5, wherein the means for determining the position are designed to switch at least one of the control panel, a controller of the rail vehicle or the rail vehicle into an auxiliary operating mode.

7. The vehicle body according to claim 6, wherein, in the auxiliary operating mode, at least one of the following elements is bypassable:

a controller of an automatic connecting door opening of one or more connecting doors, or a main controller of the rail vehicle.

8. The vehicle body according to claim 1, wherein a plane in which the control elements are arranged is oriented at least one of substantially horizontally, in the operating position, or substantially vertically, in the rest position.

9. The vehicle body according to claim 1, wherein a pivoting movement of the control panel transversely extends in a plane at right angles to the travel direction.

10. A rail vehicle comprising a vehicle body according to claim 1.

11. The rail vehicle according to claim 10, comprising a main control panel.

12. A control panel for a vehicle body according to claim 1, wherein the control panel has at least one end plate and an arrangement of control elements.

13. The vehicle body according to claim 1, wherein the control panel is pivotable from the operating position out the clearance into the rest position.

* * * * *